US005625394A

United States Patent [19]

Fukuda et al.

[11] Patent Number: 5,625,394

[45] Date of Patent: Apr. 29, 1997

[54] DIRECT COLOR THERMAL PRINTING METHOD PREVENTING YELLOW STAINS

[75] Inventors: Hiroshi Fukuda; Kazuo Miyaji, both of Saitama, Japan

[73] Assignee: Fuji Photo Film Co., Ltd., Kanagawa, Japan

[21] Appl. No.: 382,494

[22] Filed: Feb. 2, 1995

[30] Foreign Application Priority Data

Feb. 8, 1994 [JP] Japan ..... 6-014673

[51] Int. Cl.[6] ..... B41J 2/32; B41J 2/38

[52] U.S. Cl. ..... 347/175

[58] Field of Search ..... 347/175, 186; 400/120.03, 120.08

[56] References Cited

U.S. PATENT DOCUMENTS 5,268,707 12/1993 Katsuma et al. .

*Primary Examiner*—Huan H. Tran

*Attorney, Agent, or Firm*—Birch, Stewart, Kolasch & Birch

[57] ABSTRACT

A color thermosensitive recording sheet is formed by sequentially laying a cyan thermosensitive coloring layer, a magenta thermosensitive coloring layer, and a yellow thermosensitive coloring layer on a base. On this color thermosensitive recording sheet, a color image is printed with a thermal head by a three-color image sequential printing method. Each thermosensitive coloring layer develops color by a bias heating and an image heating. A bias heat energy slightly short of the coloring of a thermosensitive coloring layer to be colored and an image heat energy corresponding to the coloring density are used. A blank area is formed in the background of a binary image such as characters and line drawings. A blank frame is formed surrounding a half tone image area, Rearing elements facing such a blank area and a blank frame make a bias heating at a heat energy approximate to the magenta bias heat energy, for printing to the lowermost cyan thermosensitive coloring layer. The heating elements for printing the binary image or the half tone image make the bias heating at the cyan bias heat energy. For a postcard having a half tone image area and a binary image area juxtaposed with the half tone image area, the first several lines of the binary image area are inhibited from being printed for yellow and magenta, and the cyan image is dummy-printed at the magenta bias heat energy, so as to avoid a color registration shift of the binary image.

16 Claims, 12 Drawing Sheets

4
PA
P1
α1
α2
α3
HP
S
M
20a
HA
20
αy
αm
αc
D

DIRECT COLOR THERMAL PRINTING METHOD PREVENTING YELLOW STAINS

BACKGROUND OF THE INVENTION

1. Field of the Invention

The present invention relates to a direct color thermal printing method, and more particularly to a method of preventing yellow color stains.

2. Description of the Related Art

A direct color thermal printing method directly develops colors on a color thermosensitive recording sheet by heating it with a thermal head. As disclosed, for example, in U.S. Pat. No. 5,268,707, a color thermosensitive recording sheet has a cyan thermosensitive coloring layer, a magenta thermosensitive coloring layer, and a yellow thermosensitive coloring layer, respectively laid on a base in this order from the bottom. Each thermosensitive coloring layer has a different heat sensitivity in order to selectively develop colors on each thermosensitive coloring layer. The uppermost yellow thermosensitive coloring layer has a highest heat sensitivity, and the lowermost cyan thermosensitive coloring layer has a lowest heat sensitivity. In order not to develop colors on an overlying already colored thermosensitive coloring layer when the underlying thermosensitive coloring layer is colored, the already colored thermosensitive coloring layer is optically fixed by applying particular electromagnetic rays thereto.

Each heating element of a thermal head heats a color thermosensitive coloring sheet at a coloring heat energy ($mJ/mm^2$) sufficient for obtaining a desired coloring density which heat energy is determined by a characteristic curve specific to each thermosensitive coloring layer. An ink dot is therefore recorded in each pixel having a virtually partitioned square area on a color thermosensitive recording sheet. This coloring heat energy is a sum of a heat energy having a level slightly short of starting coloring (hereinafter called a bias heat energy) and a heat energy for coloring at a desired density (hereinafter called an image heat energy). The bias heat energy has a constant level determined by the type of a thermosensitive coloring layer, whereas the image heat energy changes with image data representing a tonal level.

With a color thermal printer adopting a direct color thermal printing method, a thermal head and a color thermosensitive recording sheet are moved relatively to record a full-color image by sequentially printing three color images. For example, a platen type color thermal printer has a thermal head extending in a main scan direction and a platen drum rotating intermittently or continuously in a subsidiary scan direction. This platen drum is constituted by a metal shaft and a drum made of black hard rubber and fixed to the metal shaft. A color thermosensitive recording sheet is wound on the circumferential wall of the drum. As the platen drum is rotated and the color thermosensitive recording sheet is moved in the subsidiary scan direction, the thermal head presses and heats the print area of the color thermosensitive recording sheet. As soon as the back end of the print area passes under the thermal head, the thermal head is moved upward to detach it from the color thermosensitive recording sheet.

During the first rotation of the platen drum, the thermal head heats a color thermosensitive recording sheet to print a yellow image one line after another on the uppermost yellow thermosensitive coloring layer. After the yellow image is printed, ultraviolet rays having an emission peak of a wavelength of 420 nm are applied to the color thermosensitive recording sheet to optically fix the yellow image. Only a diazonium salt compound still not developing color in the yellow thermosensitive coloring layer is optically decomposed and the yellow thermosensitive coloring layer loses its coloring ability. During the second rotation of the platen drum, the thermal head heats a color thermosensitive recording sheet by a heat energy larger than printing the yellow image to sequentially print a magenta image one line after another on the magenta thermosensitive coloring layer. After the magenta image is printed, ultraviolet rays having an emission peak of 365 nm are applied to the color thermosensitive recording sheet to remove the coloring ability of the magenta thermosensitive coloring layer. During the third rotation, the thermal head heats the color thermosensitive recording sheet at the highest heat energy to print a cyan image one line after another on the cyan thermosensitive coloring layer.

If a cyan bias heat energy slightly short of starting coloring is applied to the white blank area of the color thermosensitive recording sheet not designated for recording of an image, the blank area changes to a light yellow colored area. This phenomenon is called yellow stains. Before the cyan printing process, the blank area has been optically fixed after the yellow and magenta printing. With this fixing processes, impurities are generated. These impurities are generally decomposed and removed in four to five hours. However, if a large heat energy is applied to impurities, they are thermally fixed and become light yellow substances which are yellow stains.

Although yellow stains in a half tone image are unobtrusive, those in an image having characters (such as title characters and compliments sentences) printed in black or other colors in a blank area or those in a binary image such as line drawings are obtrusive and the print quality is degraded. If a thermal head is longer than the lateral side of a print area, some heating elements face the outer area of the half tone print area. Although these heating elements are supplied with image data "0" and do not perform an image heating, they perform a bias heating like the other heating elements. Therefore, the bias heating of the cyan printing process generates yellow stains on the blank frame in the outside of the print area. The gloss of the blank frame is also reduced and degraded by a high temperature bias heating. In the case of a postcard having a half tone image area and a binary image area, yellow stains formed on the binary image area lower the finished quality.

A friction coefficient between a color thermosensitive recording sheet and a thermal head changes with the heat energy generated by a thermal head as shown in FIG. 13, assuming that the force of pressing the color thermosensitive recording sheet by the thermal head is constant. A friction coefficient becomes low as the temperature of the thermal head rises. With a small friction coefficient, the feed load of the color thermosensitive recording sheet becomes small. A thermal head is generally powered to print an image after it is pressed against a color thermosensitive recording sheet. Therefore, the feed loads before and after powering are different. As the feed load changes, the rotary shaft of a platen drum is twisted, the hard rubber of the platen drum is deformed, or the drive belt for rotating the platen drum is elongated or shortened. These recoverable status change is collectively called a sheet feed system distortion, for the purpose of description simplicity.

A distortion amount of the sheet feed system is determined by the sheet feed load. If the sheet feed load is constant, a color thermosensitive recording sheet can be fed at a desired speed and with the constant distortion amount corresponding to the feed load. However, if the sheet feed load changes, the sheet feed system distortion changes correspondingly. As the distortion amount changes, the feed speed of a color thermosensitive recording sheet changes temporarily. When and after the thermal head is powered, the distortion amount of the sheet feed system reduces temporarily. As a result, the feed speed of a color thermosensitive recording sheet increases temporarily, the width of a printed line is broadened, and the coloring density lowers.

The coloring heat energy of a color thermosensitive recording sheet differs between colors so that the friction coefficient also differs between colors. Since the distortion amount of the sheet feed system becomes different between colors, a color registration shift occurs lowering the print quality.

SUMMARY OF THE INVENTION

It is a principal object of the present invention to provide a direct color thermal printing method capable of preventing generation of yellow stains on a white blank area of a color thermosensitive recording sheet.

It is another object of the present invention to provide a direct color thermal printing method capable of suppressing a density variation and a color registration shift to be caused by a load change in a sheet feed system.

The above and other objects of the invention can be achieved by applying a small heat energy of a bias heating during a cyan printing process to the heating elements facing a blank area not to be designated for printing of an image. Although an image heating is not performed, a bias heating is performed for the heating elements facing a blank area during the yellow, magenta, and cyan printing processes. If during the cyan image printing process the heating elements facing the blank area generate a cyan bias heat energy slightly short of starting coloring of a cyan thermosensitive coloring layer, yellow stains are formed by thermal fixation. According to the present invention, during the bias heating of the cyan printing process, the heating elements facing a blank area generate a small heat energy not allowing thermal fixation, for example, a magenta bias heat energy slightly short of starting coloring of a magenta thermosensitive coloring layer.

A blank area not designated for printing of an image is, for example, a partial area in a character print area where a binary image such as a character image and a line drawing is not formed. Another example of the blank area is a blank frame in the outside of a print area where heating elements face the blank frame, in the case where the heating element array of the thermal head is longer than the parallel sides of the print area of a color thermosensitive recording sheet.

According to a preferred embodiment of the present invention, the thermal head is pressed against a color thermosensitive recording sheet and fed from the preliminary pressed running start position to the print area. The length of the preliminary running section is changed with colors in order to eliminate a color registration shift. The number of lines in the preliminary running section, i.e., the number of pulse motor steps, is the same for all colors. In order to reduce a difference between the friction coefficients at the preliminary running section and at the print area, the thermal head is preheated to the degree that the color thermosensitive recording sheet does not develop color. The heat energy of preheating is preferably a bias heat energy of color to be developed.

The print area of some postcard has a half tone image area and a binary image area juxtaposed in the subsidiary direction. During the cyan binary image printing operation, the heating elements for printing an image area are heated by a cyan bias heat energy, whereas the heating elements facing a blank area are heated by a heat energy smaller than the cyan bias heat energy. In printing yellow and magenta images in the binary image area, first several lines are used as the binary image print inhibited area and subjected to only bias heating. As a result, the image data to be printed on these lines are discarded. On the other hand, in printing a cyan binary image, dummy print lines are provided in correspondence with the print inhibited area. After a dummy print is performed for the dummy print lines, the binary image is sequentially printed starting from the first line. This dummy printing is performed at approximately the magenta bias heat energy.

According to the present invention, the blank area where an image is not printed, is subjected to the cyan bias heating at a small heat energy. Therefore, yellow stains are not formed in the blank frame or the blank area in the character print area. Since the small heat energy is used, power consumption can be reduced, and a character print mark with a poor surface glaze is not formed.

Since the print inhibited area and the dummy print lines are provided, even if the heat control for suppressing the generation of yellow stains in the blank area in a character print area is performed, the cyan binary image and the magenta and yellow binary images are not printed in displaced positions so that the contour of a character such as a black character has no blur.

The preliminary running section is prepared before the print area. In this running section, the thermal head is preheated while it pushes a color thermosensitive recording sheet. The length of the preliminary running section is changed with colors so that the print start positions of respective colors coincide and a color registration shift can be suppressed. Since the thermal head is preheated during the preliminary running, the friction coefficient between the thermal head and the recording sheet gradually takes a value near the friction coefficient at the print area. Therefore, it becomes possible to reduce a sheet feed change near at the start position of the print area. This friction coefficient change can be suppressed further, particularly by setting the preheating heat energy approximate to the bias heat energy of color to be printed. In printing a cyan image, preheating is performed at approximately the magenta bias heat energy. It is therefore possible to suppress the generation of yellow stains in the preliminary running section.

If a cool thermal head is driven, a desired temperature is difficult to be obtained in a short time so that the coloring density becomes low at the area near the start position of the print area and a so-called shading occurs. In the case of a three-color frame sequential printing, shading of a first printed yellow image is large so that a color balance is degraded. According to the present invention, preheating is incorporated so that the generation of shading and the degradation of a color balance can be avoided.

In the preliminary running section, the thermal head is moved down to push a color thermosensitive recording sheet. Therefore, the sheet feed load increases and the sheet feed speed lowers. In such a case, the heat energy of preheating is concentrated upon a local area of the color thermosensitive recording sheet and it may develop color. First several lines in the preliminary running section are therefore applied with a heat energy of preheating which is generally a half of the bias heat energy.

Such a preliminary running control and a yellow stain suppression control can be performed easily only by changing the print sequence, as compared to devise to improve the rigidity of the sheet feed system.

BRIEF DESCRIPTION OF THE DRAWINGS

The above and other objects and advantages of the present invention will become apparent from the detailed description of the preferred embodiments when read in conjunction with the accompanying drawings, in which:

FIG. 6D shows the result of printing under the conditions explained with FIG. 6C;

DETAILED DESCRIPTION OF THE PREFERRED EMBODIMENTS

Figure 1:
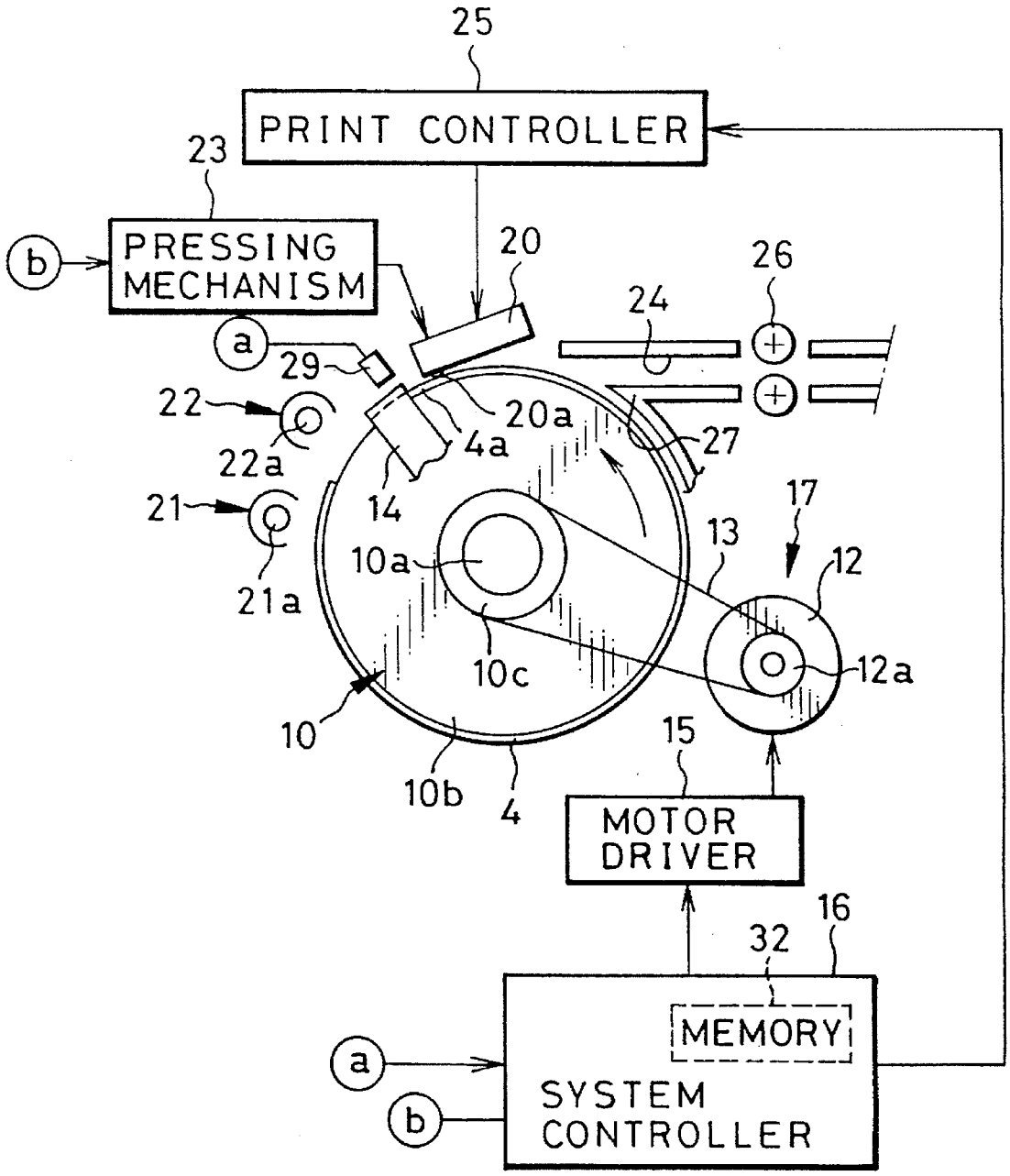
FIG. 1 is a schematic diagram showing the main part of a color thermal printer.

Referring to FIG. 1, a platen drum 10 is constituted by a metal shaft 10*a*, a drum 10*b* made of black hard rubber, and a pulley 10*c* fixed to the shaft 10*a*. The platen drum 10 rotates in the direction indicated by an arrow while holding a color thermosensitive recording sheet 4 in position on the circumferential wall of the platen drum 10. A pulse motor 12 has its shaft fixed to a pulley 12*a*. Between the pulley 10*c* and pulley 12*a*, a timing belt 13 made of rubber is extended.

A clamper 14 is mounted on the platen drum 10. The clamper 14 fixes the front end portion 4*a* of the color thermosensitive recording sheet 4 to the platen drum 10. The rotation of the pulse motor 12 is controlled by a system controller 16 via a motor driver 15. The system controller 16 generates motor drive pulses. The platen drum 10 is caused by four motor drive pulses to rotate at an amount of one line. A sheet transport system 17 is constituted by the platen drum 10, pulse motor 12, timing belt 13, and clamper 14.

Disposed near the outer circumference of the platen drum 10 are a thermal head 20, and first and second optical fixing units 21 and 22. The thermal head 20 has a heating element array HA (refer to FIG. 4) at the bottom on the front end side. As well known, the heating element array HA has a number of heating elements 20*a* disposed in line. Each heating element has lengths of, for example, 140 microns both in the main scan direction and subsidiary scan direction. At a preliminary pressed running section and a print area, the thermal head 20 is maintained moved down by a pressing mechanism 23 so that the heating element array HA is pushed against the color thermosensitive recording sheet 4. When the back end of the print area passes under thermal head 20, the pressing mechanism 23 moves up the thermal head 20 to detach it from the color thermosensitive recording sheet 4.

The pressing mechanism 23 is constituted by a spring for biasing the thermal head 20 upward and a cam for biasing the thermal head 20 downward. A solenoid mechanism or a link mechanism may be used so long as it can push the thermal head 20 against the platen drum 10 at a predetermined pressure. At the preliminary running section and the print area, the thermal head 20 is driven by a print controller 25 to heat each heating element 20*a*.

The first optical fixing unit 21 has a rod type ultraviolet lamp 21a which radiates ultraviolet rays having an emission peak of about 420 nm wavelength to optically fix a yellow thermosensitive coloring layer. The second optical fixing unit 22 has a rod type ultraviolet lamp 22*a* which radiates ultraviolet rays having an emission peak of about 365 nm wavelength to optically fix a magenta thermosensitive coloring layer.

On a sheet feed/discharge path 25, a feed roller pair 26 is disposed for nipping the color thermosensitive recording sheet 4 and transporting it. A separation claw 27 is formed with the sheet feed/discharge path 25 on the side of the platen drum 10 for guiding the back end of the color thermosensitive recording sheet 4 to the sheet feed/discharge path 25. In this embodiment, the one path is used for both the sheet feed path and sheet discharge path. Two paths may be provided separately. Also in this embodiment, a reverse sheet discharge system is adopted in which the color thermosensitive recording sheet 4 is discharged by rotating the platen drum 10 in the reverse direction as opposed to that used in printing. Instead, a normal sheet discharge system may be used in which the color thermosensitive recording sheet 4 is discharged by rotating the platen drum 10 in the same direction as that in printing. In the normal sheet discharge system, the clamper 14 is moved upward (to an open state) and the platen drum 10 is rotated in the normal direction while the color thermosensitive recording sheet 4 is pushed by the thermal head 20. The color thermosensitive recording sheet 4 passes under the clamper 14 in the open state and is guided to a sheet discharge path.

A home position sensor 29 is disposed near the outer circumference of the platen drum 10. The home position sensor 29 detects a home position of the platen drum 10 by optically detecting the clamper 14. This home position detected signal is sent to the system controller 16. When the front end of the color thermosensitive sheet 4 enters the clamper 14 in the open state, the clamper 14 is closed to fix the front end portion of the color thermosensitive recording sheet 4 to the platen drum 10.

The system controller 16 made of a general microcomputer sequentially controls the constituent elements of the color thermal printer. The system controller 16 also controls the preliminary running to reduce a feed fluctuation at the start of printing and to eliminate the color registration shift. It also controls a yellow stain compensation during the cyan printing process to suppress a change of the white blank area to yellow.

Figure 2:
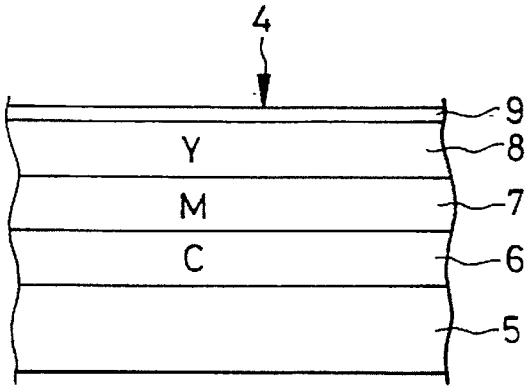
FIG. 2 is a diagram explaining an example of a layer structure of a color thermosensitive recording sheet.

FIG. 2 shows the layer structure of a color thermosensitive recording sheet. The color thermosensitive recording sheet 4 has a cyan thermosensitive coloring layer 6, a magenta thermosensitive coloring layer 7, a yellow thermosensitive coloring layer 8, and a protective layer 6, respectively laid in this order on a support base 5. The thermosensitive coloring layers 6 to 8 are laid in the order of thermal printing from the surface of the color thermosensitive recording sheet. If thermal printing is performed in the order of magenta, yellow, and cyan, the yellow thermosensitive coloring layer and the magenta thermosensitive coloring layer are exchanged. A four-layer structure with an additional black layer may be used.

Figure 3:
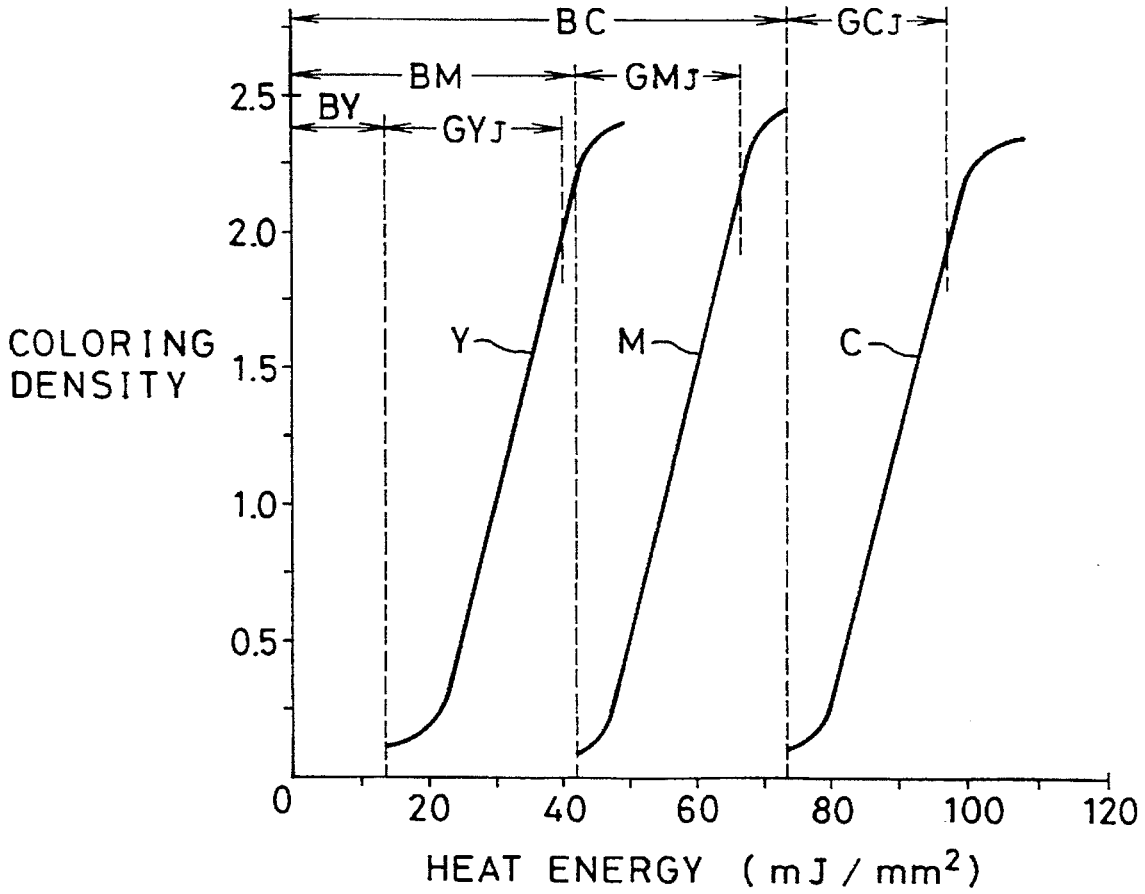
FIG. 3 is a graph showing an example of the coloring characteristics of a color thermosensitive recording sheet.

FIG. 3 is a graph showing the coloring characteristics of a color thermosensitive recording sheet. The abscissa represents a heat energy applied to a color thermosensitive recording sheet by a heating element. The yellow thermosensitive coloring layer 8 is the uppermost layer so that it has a smallest coloring heat energy. The cyan thermosensitive coloring layer 6 is the lowermost layer so that it has a largest coloring heat energy. In practice, an intermediate layer is formed between adjacent thermosensitive coloring layers in order to adjust a heat sensitivity of each thermosensitive coloring layer.

In order to print a yellow dot in a pixel of yellow Y, an image heat energy $GY_J$ determined by a tonal level J of the pixel, in addition to a bias heat energy BY slightly short of starting coloring, is applied to the color thermosensitive recording sheet 4. The heat energies for magenta M and cyan C are similar to that of yellow Y. In FIG. 3, these energies are discriminated by adding color symbol characters Y, M and C.

Figure 4:
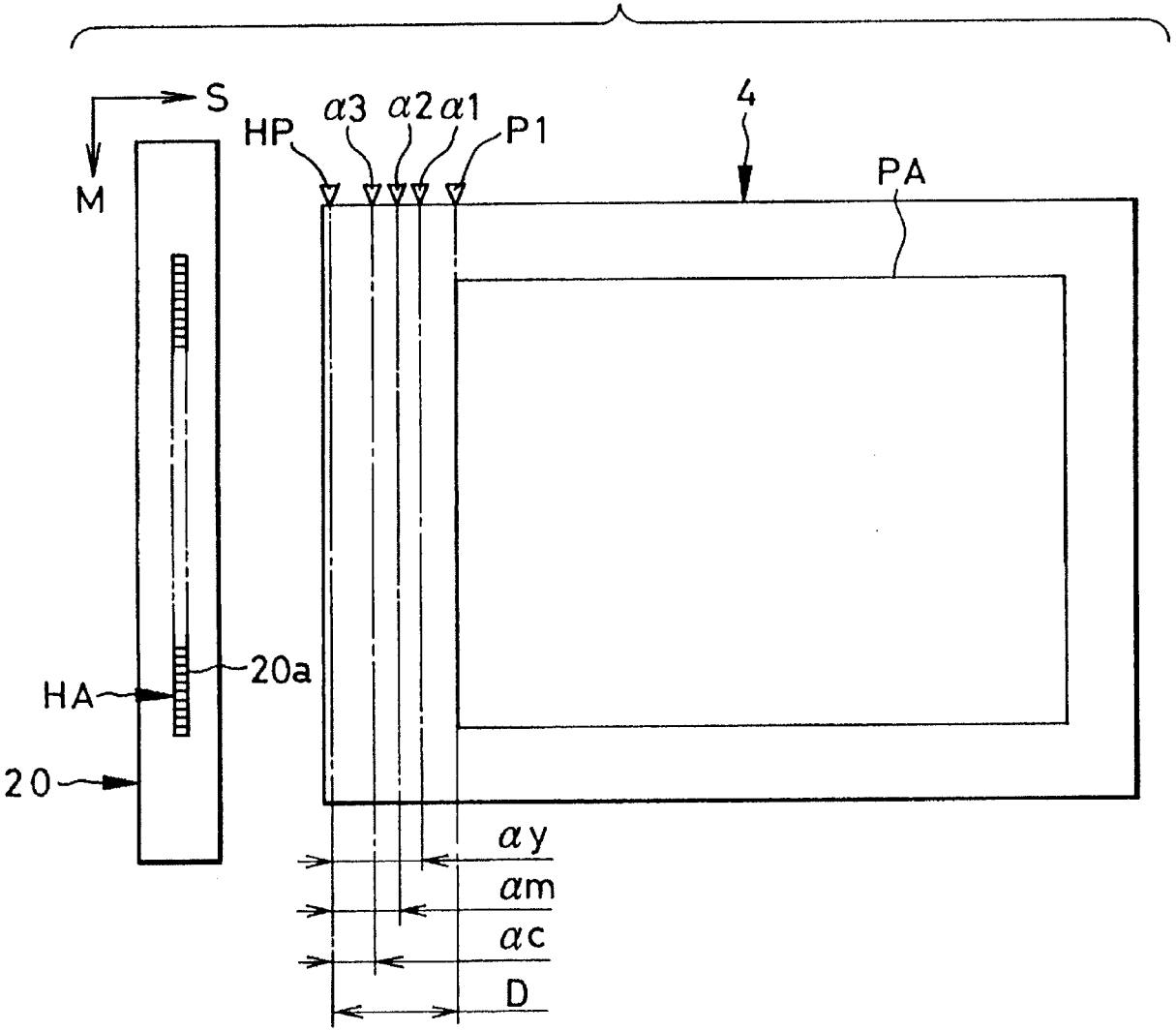
FIG. 4 is a diagram explaining the relationship between preliminary pressed running start positions of a thermal head and print areas.

FIG. 4 is a schematic diagram showing preliminary running sections. The preliminary running with preheating prevents a feed fluctuation of the color thermosensitive recording sheet 4 from being generated when each heating element 20*a* of the thermal head 20 reaches the print start position (first line) P1 of a print area PA of the color thermosensitive recording sheet 4. As a result, generation of shading or degradation of color balance can be avoided which might otherwise be caused by an insufficient heat energy at the start portion of the print area PA.

The yellow stain compensation is performed at a blank area during the cyan printing process. Those heating elements facing the blank area execute a bias heating at approximately the magenta bias heat energy BM. As a result, impurities are prevented from being thermally fixed and changed to yellow stains during the cyan bias heating. This yellow stain compensation is performed for those heating elements facing the blank area in a black or color character area, the blank area in a binary image area, or the blank frame outside of a half tone image area. The yellow stain compensation is not necessarily required to be performed for a half tone image area having less blank area, because yellow stains are not obtrusive.

The feed load caused by the friction coefficient during the cyan printing process for a binary image such as characters and line drawings is larger than for a half tone image, because the former requires the yellow stain compensation and the latter does not require the yellow stain compensation. Therefore, the preliminary running start position when a half tone image is printed is made different from that when a binary image is printed. During the yellow and magenta printing processes, the preliminary running start position is not changed.

First, the preliminary running control to be performed when a half tone image is printed will be described. A memory 32 in the system controller 16 (refer to FIG. 1) is written with the preliminary running start position data Pαy, Pαm, and Pαc. These data Pαy, Pαm, and Pαc represent the numbers of drive pulses of the pulse motor 12 corresponding to the distances αy, αm and αc from the home position HP to the preliminary running start positions α1, α2 and α3 whereat the thermal head 20 is moved down.

In order to suppress a fluctuation of the friction coefficient at the preliminary running section and the print area, preheating during the preliminary running is performed at a different heat energy for each color. Therefore, the distortion amount of the sheet feed system is different at each color in the preliminary running section. As a result, the position of the first line of each color becomes different and a color registration shift is generated. In order to eliminate this color registration shift, the distances αy, αm, and αc are made different at each color.

The distortion amount of the sheet feed system changes with various parameters such as an elasticity of the rubber of the platen drum 10, the material of the timing belt 13, the surface roughness of a color thermosensitive recording sheet, and a pressing force of the thermal head 20. Therefore, the distances αy, αm, and ac are determined in advance by experiments and converted into the preliminary running start positions Pαy, Pαm, and Pαc which are stored in the memory 32 in the system controller 16. The number of lines from the home position to the print area, i.e., the number of motor drive pulses, is the same for each color. Therefore, by changing the preliminary running start position by an amount corresponding to the distortion amount of the sheet feed system of each color, the first lines of three colors become coincident. The width of one line is, for example, 140 microns.

In printing a yellow image, the system controller 16 counts the number of motor drive pulses starting from when the home position signal is detected. When this count reaches Pαy, the system controller 16 judges that the thermal head reaches the preliminary running start position α1. Immediately thereafter, the system controller 16 actuates the pressing mechanism 23 to push the heating element array HA of the thermal head 20 against the color thermosensitive recording sheet 4. At this time, each heating element 20*a* of the thermal head 20 is preheated at a predetermined heat energy, for example, the yellow bias heat energy BY. Alternatively, the thermal head 20 may be pushed against the color thermosensitive recording sheet 4 after it has been preheated in advance.

After the preliminary running for a predetermined number of lines, the heating element array HA faces the first line (printing start position P1) of the print area PA and prints the first line of the yellow image. As the preliminary running start position data in the memory 32, instead of Pαy, Pαm, and Pαc, "A-Pαy", "A-Pαm", and "A-Pαc" referenced to the home position may be used, where A represents the number of drive pulses of the pulse motor 12 corresponding to the distance D from the home position HA to the printing start position P1.

Also in printing a magenta image, the system controller 16 counts the number of motor drive pulses starting from when the home position HP is detected. When this count reaches Pαm, the system controller 16 judges that the heating element array HA reaches the preliminary running start position α2. Immediately thereafter, the system controller 16 actuates the pressing mechanism 23 to push the heating element array HA of the thermal head 20 against the color thermosensitive recording sheet 4. At this time, each heating element 20*a* of the thermal head 20 is preheated. The magenta bias heat energy BM is used for this preheating. After the preliminary running by the same lines as yellow, the first line of the magenta image is printed.

Also in printing a cyan image, the preliminary running is performed by the same lines as above after counting the drive pulses of Pαc starting from when the home position HP is detected. The cyan bias heat energy is used for this preliminary running. If yellow stains are to be avoided, the preheating may be performed at the magenta bias heat energy. As described above, because the number of lines in the preliminary running section of each color is the same, this cyan printing process has the largest preliminary running start position shift "A-Pαc".

Figure 5:
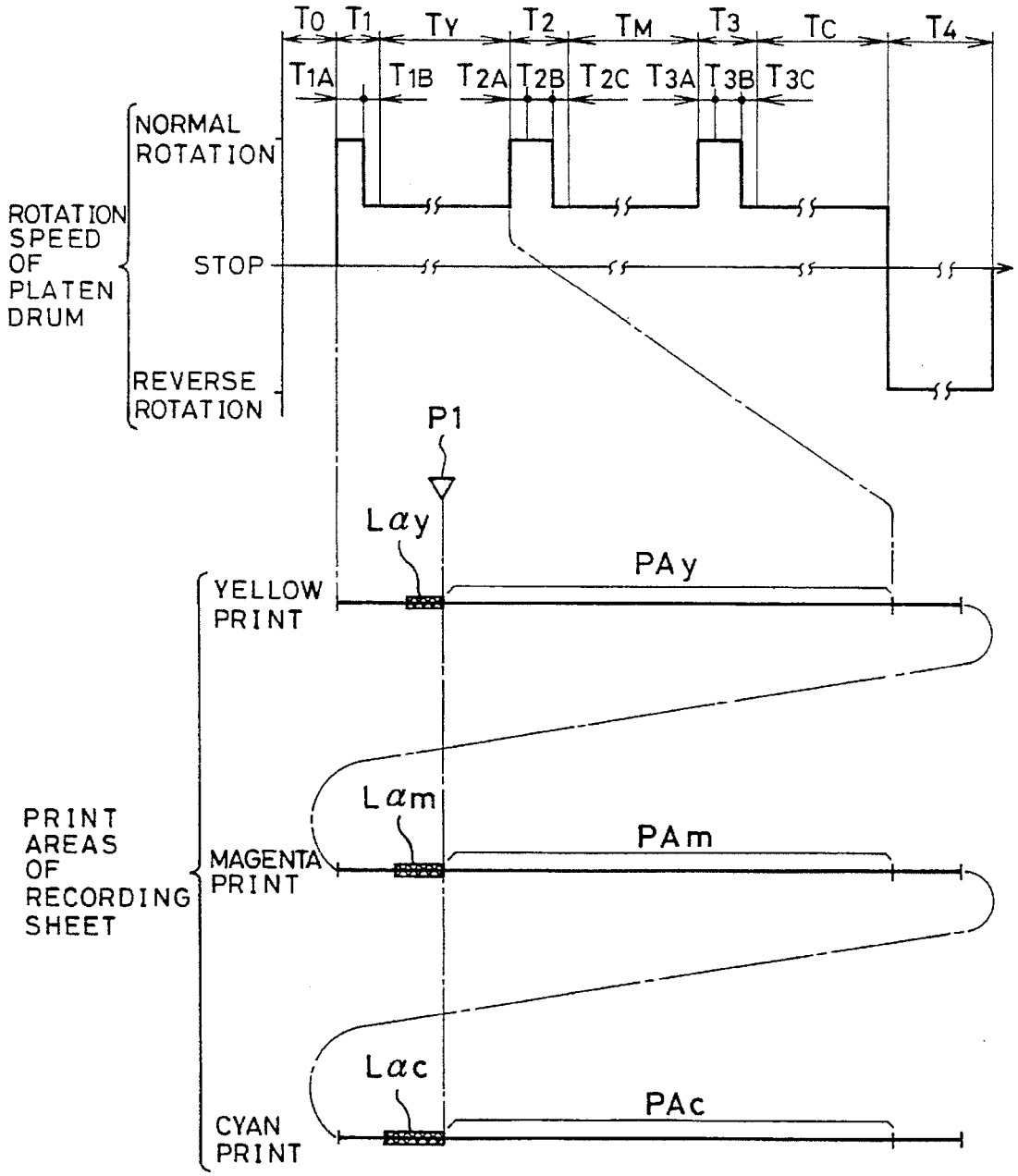
FIG. 5 is a diagram explaining the relationship between a rotation speed of a platen drum and the position of each print area of each color.

FIG. 5 is a diagram explaining the relationship between the rotation state of the platen drum 10 and the feed amount of a recording sheet. T0 is a time period from when a print start button is pushed and a sheet feed starts to when the color thermosensitive recording sheet 4 reaches the clamp position (home position HP). During this time period, the platen drum 10 is stationary. T1 represents a time period from when the clamper 14 fixes the front portion 4*a* of the color thermosensitive recording sheet 4 to the circumferential wall of the platen drum 10 to when the print start position P1 (first line) of the print area PA of the color thermosensitive recording sheet 4 reaches the heating element array HA. This time period T1 is divided into T1A and T1B: the feed time T1A from when the platen drum 10 starts a high speed rotation to when the color thermosensitive recording sheet 4 reaches the preliminary running start position α1, and the preliminary running time T1B required for a preliminary running at a normal printing speed from the preliminary running start position α1 to the print start position P1. The thermal head 20 is moved down at this preliminary running start position α1 to push the color thermosensitive recording sheet 14.

TY is a total time period of a yellow print time for the print area PA and the succeeding time required for the completion of yellow optical fixation. The thermal head 20 is moved up to a retracted position from the color thermosensitive recording sheet 4 after the last line is printed.

T2 is a time period required for moving the print start position P1 of the print area PA to the heating element array HA. This time period T2 is divided into T2A, T2B and T2C: the time period T2A required for moving the color thermosensitive recording sheet 4 to the home position HP by rotating the platen drum at a high speed immediately after the yellow image is printed, the time period T2B required for moving the color thermosensitive recording sheet 4 from the home position HP to the preliminary running start position α2 at a high speed, and the preliminary running time period T2C for moving the color thermosensitive recording sheet 4 from the preliminary running start position α2 to the print start position P1 of the print area PA at a normal printing speed. The thermal head 20 is moved down again at this preliminary running start portion α2 to push the color thermosensitive recording sheet 4.

TM is a total time period of a magenta print time for the print area PA and the succeeding time required for the completion of magenta optical fixation. After the magenta image is printed, the thermal head 20 is moved up. T3 is a time period required for the print start position P1 of the print area PA to reach the heating element array HA after the magenta image is printed. This time period T3 is divided into T3A, T3B and T3C: the time period T3A required for moving the color thermosensitive recording sheet to the home position HP by rotating the platen drum at a high speed immediately after the magenta image is printed, the time period T3B required for moving the color thermosensitive recording sheet from the home position HP to the preliminary running start position α3 at a high speed, and the preliminary running time period T3C for moving the color thermosensitive recording sheet from the preliminary running start position α3 to the print start position P1 of the print area PA at a normal printing speed. The thermal head 20 is moved down again at this preliminary running start portion α3 to push the color thermosensitive recording sheet 4. TC is a time period required for printing a cyan image, and T4 is a reverse sheet discharge time period.

During the preliminary running time periods T1B, T2C, and T3C (T1B=T2C=T3C), the thermal head 20 is preheated. As the heat energy of this preheating, a bias heat energy of a thermosensitive coloring layer to be designated for printing is used. The preliminary running with preheating saturates the distortion amount of the sheet feed system. The distortion amount corresponds to the sheet feed load. The preliminary running lengths Lαy, Lαm, and Lαc (Lαy<Lαm<Lαc) shown in FIG. 5 are therefore obtained. In this manner, the print start positions P1 of the actual print areas PAy, PAm and PAc of respective colors become coincident. With the preheating during the preliminary running, friction coefficients during the preliminary running and during the printing are nearly equal, so that a feed fluctuation near the print start position P1 can be suppressed.

Figure 6A:
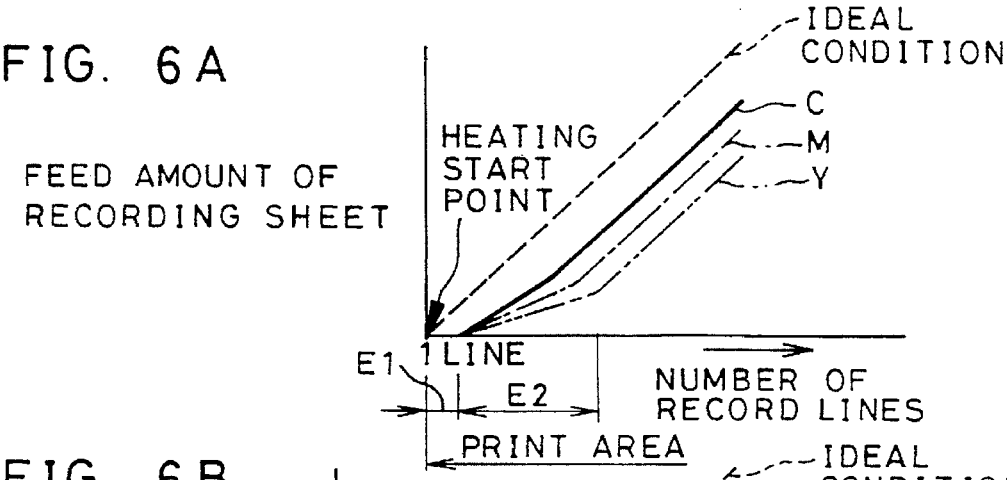
FIGS. 6A to 6D are diagrams explaining the relationship between the number of print lines and the feed amount of a color thermosensitive recording sheet, FIG. 6A stands for the case without preliminary running, FIG. 6B stands for the case with preliminary running without bias heating, FIG. 6C stands for the case with preliminary running with bias heating.
Figure 6B:
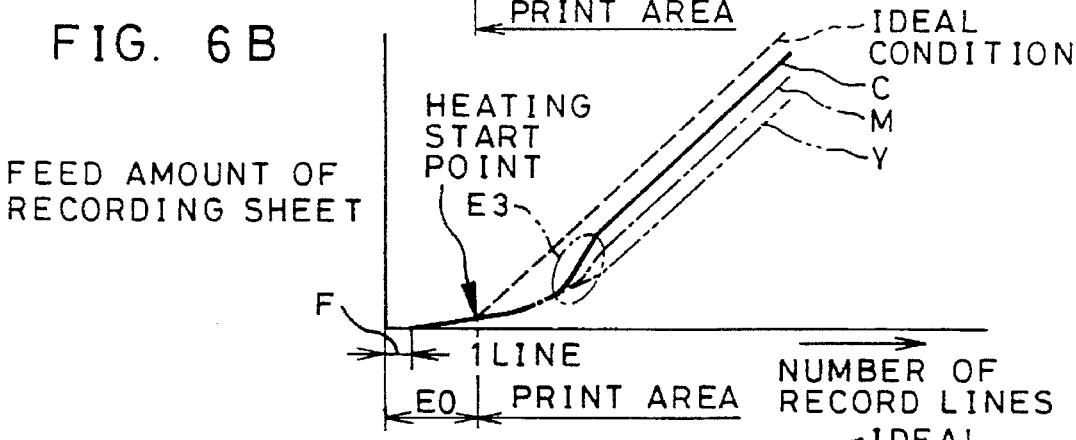
Figure 6C:
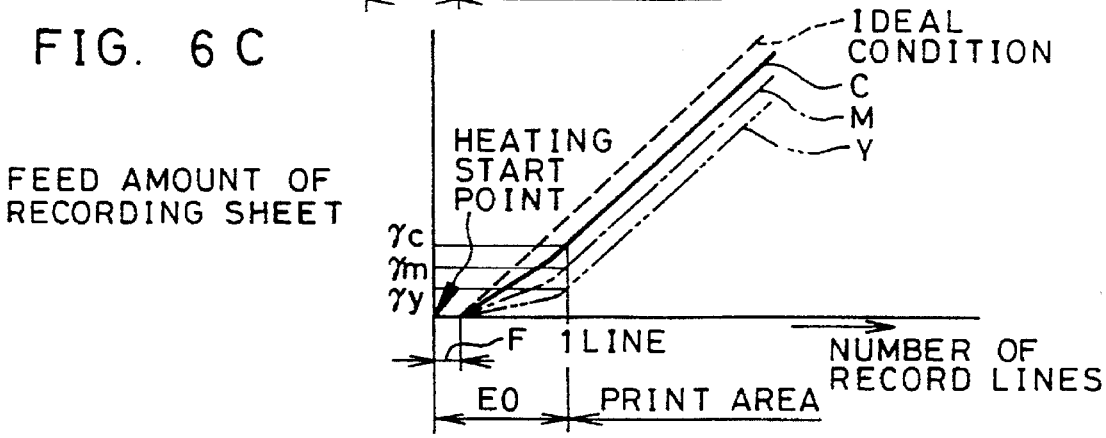
Figure 6D:
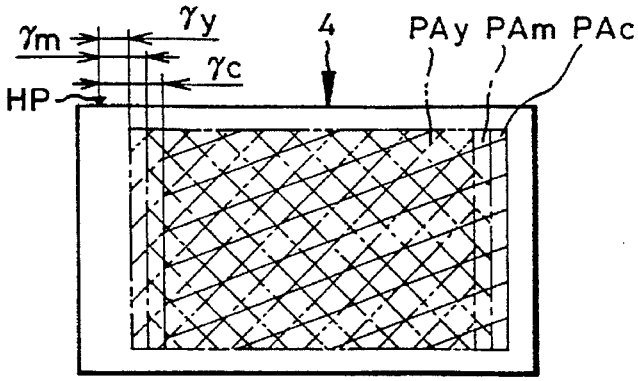

FIGS. 6A to 6D are diagrams explaining the relationship between the feed amount of a recording sheet and the number of print lines. FIG. 6A relates to the case without the preliminary running, and FIG. 6B relates to the case with the preliminary running without preheating. FIG. 6C relates to the case with the preliminary running with preheating, and FIG. 6D shows the exaggerated shifts of the print areas PAy, PAm, and PAc printed under the conditions explained with FIG. 6C. In FIGS. 6A to 6D, a cyan printing is indicated by a solid line, a magenta printing is indicated by a one-dot-chain line, and a yellow printing is indicated by a two-dot-chain line, and an ideal state with no distortion of the sheet feed system 17 is indicated by a broken line.

As shown in FIG. 6A, in printing an image immediately after pressing the thermal head without the preliminary running, only distortion is generated in the sheet feed system 17 immediately after pressing the thermal head 20. Therefore, the color thermosensitive recording sheet is hardly fed for first several lines indicated by an area E1, and thereafter the color thermosensitive recording sheet starts being fed. In an area E2 of several lines to ten and several lines corresponding to the time period from the sheet feed start to when the distortion amount of the sheet feed system 17 saturates to the value corresponding to the sheet feed load, the feed amount of the color thermosensitive recording sheet 4 is small.

During the image printing operation, the bias heat energy becomes large in the order of yellow, magenta, and cyan, so that the friction coefficient between the color thermosensitive recording sheet and the thermal head lowers correspondingly and the number of lines in the area E2 becomes large in the order of yellow, magenta, and cyan. After the distortion amount of the sheet feed system 17 is saturated, the feed speed of the color thermosensitive recording sheet 4 becomes generally constant irrespective of the different bias heat energy. As a result, the total feed amount of the color thermosensitive recording sheet 4 of each color becomes smaller than that of the ideal state, and so the actual print areas of the respective colors do not coincide. Since the color thermosensitive recording sheet 4 is hardly fed for first several lines (area E1), printed dots are superposed one upon each other. For the same reason, dot intervals (line intervals) become small for the following ten and odd lines (area E2). Although the sheet feed speed eventually takes a target value, the position of each dot printed on the recording sheet becomes different at each color because the feed amount immediately after the print start is different at each color. A color registration shift is therefore generated over the whole print area.

As shown in FIG. 6B, if the preliminary running is performed, the friction coefficient at the preliminary running area E0 is high. The color thermosensitive recording sheet 4 starts being fed at the distortion amount F. This preliminary running allows the first lines of the respective colors to coincide. However, the feed load becomes different after the print start, because the bias heat energy is different for each color. The sheet feed amount changes until the distortion amount saturates to the value corresponding to the feed load. Therefore, the interval between lines in the area E3 changes at each color so that the positions of dots of the respective colors change. If the preliminary running start position is changed, the color registration shift after the distortion amount of the sheet feed system 17 is stabilized can be avoided. However, a color registration shift is generated until the distortion amount is stabilized.

As shown in FIG. 6C, if the preliminary running with preheating is performed, the line interval in the print area becomes always constant because the distortion amount of the sheet feed system 17 is saturated during the preliminary running. The lengths of the print areas PAy, PAm, and PAc of the respective colors are also the same. However, the actual feed amounts $\gamma y$, $\gamma m$, and $\gamma c$ of the respective colors are different so that as shown in FIG. 6D, the positions of printed dots are displaced by the amount corresponding to the $\gamma y$, $\gamma m$, and $\gamma c$, and a color registration shift is generated. Therefore, as shown in FIG. 4, the preliminary running start positions of the respective colors are set to $\alpha 1$, $\alpha 2$, and $\alpha 3$ so that the print start positions P1 of the respective colors in the print area can coincide. As a result, the print areas PAy, PAm, and PAc of the respective colors can coincide, allowing to provide a three-color frame sequential print with less color registration shift.

When the thermal head is moved down at the preliminary running section to push the color thermosensitive recording sheet, the sheet feed load increases lowering the sheet feed speed abruptly. In such a case, the heat energy of preheating is concentrated on the local area of the color thermosensitive recording sheet so that coloring may occur in some case. It is therefore preferable to set the heat energy of preheating approximate to a half of the bias heat energy for first several lines in the preliminary running section.

Next, the yellow stain compensation and the preliminary running control associated with this compensation will be described. For the yellow stain compensation, a heat energy of approximately the magenta bias heat energy BM is used for bias-heating the pixel in a blank area (non-image area not designated for printing) when a cyan image of a binary image such as a title image is printed. In this manner, yellow stains can be prevented from being formed in the blank area.

Figure 7:
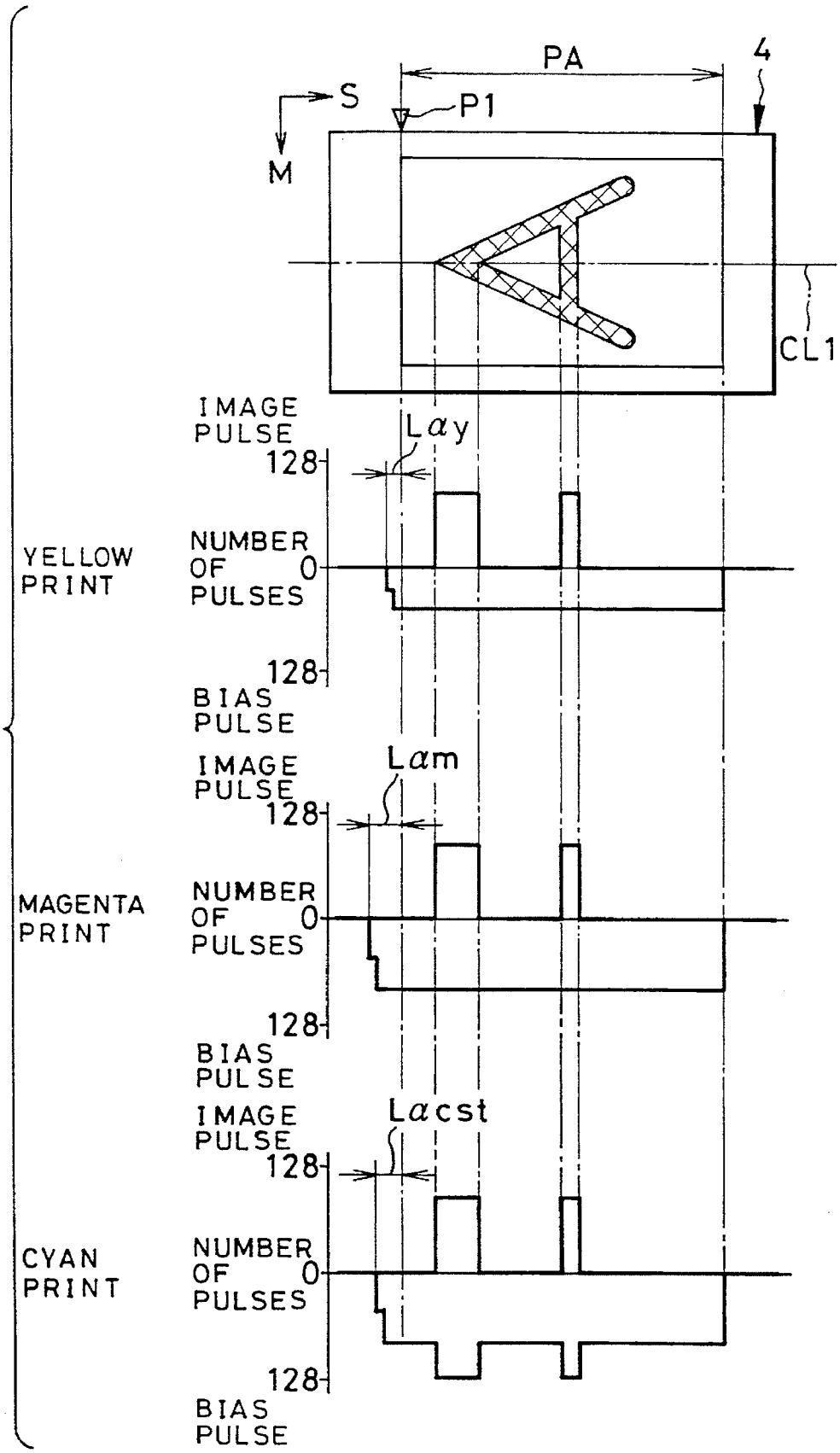
FIG. 7 explains the number of drive pulses supplied to heating elements when a character is printed on a color thermosensitive recording sheet.

FIG. 7 shows drive pulses of each color applied to a heating element which prints an image along a central line CL1 of the print area PA. In the cyan printing process, 128 bias pulses are applied to the heating element which prints a character similarly to the heating element printing a half tone image, so that the heating element is heated 128 times to generate a cyan bias heat energy BC. The heating element facing the blank area is supplied with bias pulses which generate the same heat energy as the magenta bias heat energy BM. Since the low heat energy is applied when the blank area is bias-heated, yellow stains can be prevented from being formed.

During the cyan printing operation, the blank area is bias-heated at a heat energy lower than the character area. Therefore, the generated heat amount of the heating element array HA becomes smaller than that during the cyan half tone printing process. This change in the generated heat amount changes the friction coefficient between the thermal head and the recording sheet. Therefore, the preliminary running start position data $P\alpha c$ for the cyan half tone printing process cannot be used for the cyan binary image printing process. The preliminary running start position $\alpha c_{st}$ for the cyan binary image printing process is determined from experiments in advance to calculate the preliminary running start position data $P\alpha c_{st}$ which is stored in the memory 32 of the system controller 16. In the preliminary running section of the cyan printing process, preheating is performed at the magenta bias heat energy BM so that a blur of a contour of a character or a line can be eliminated. Furthermore, at the initial stage of the preliminary running section, the heat energy of preheating is halved in order to avoid stripe-shaped coloring of the recording sheet to be caused by preheating.

Figure 8:
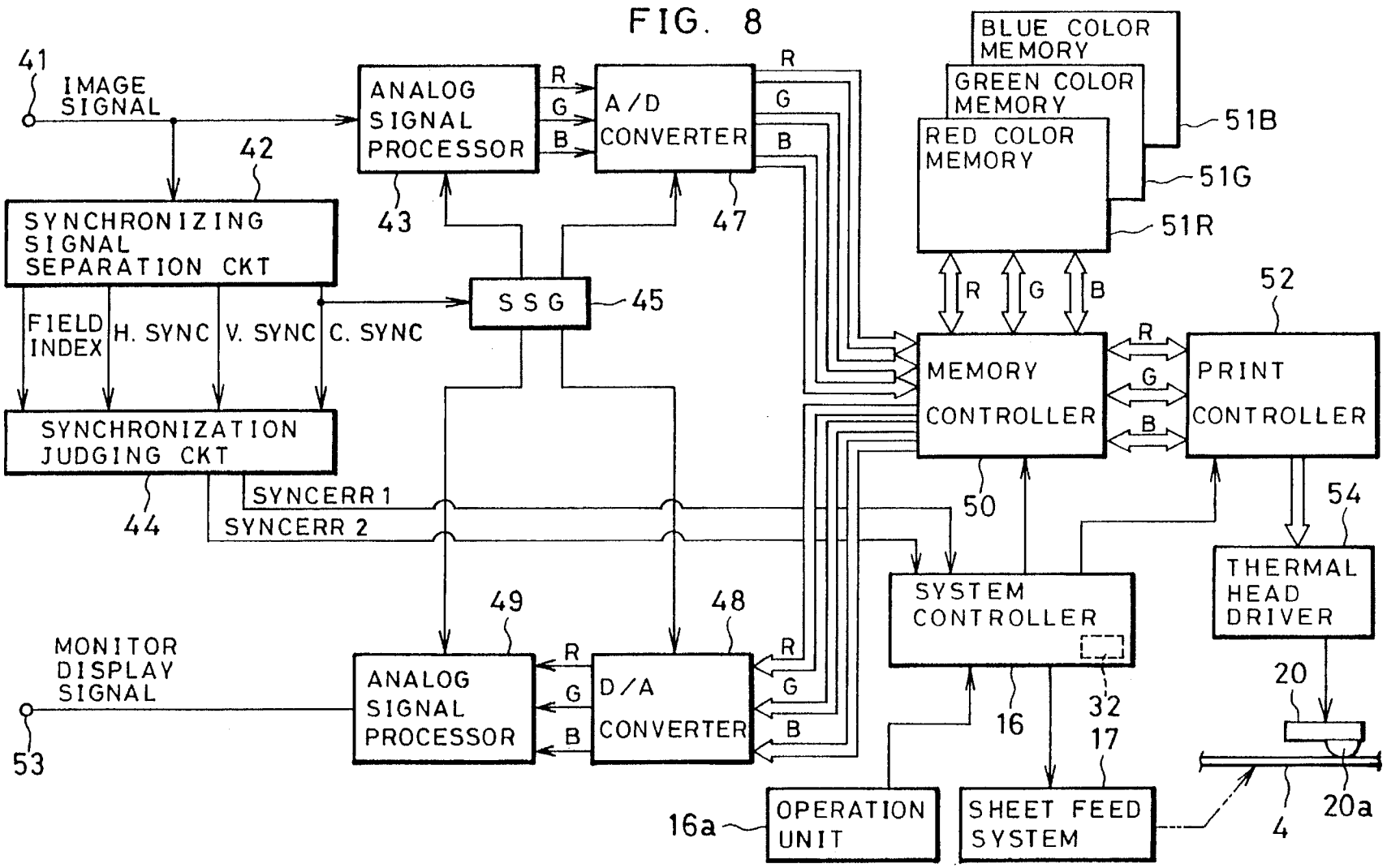
FIG. 8 is a block diagram showing the electric circuit structure of a color thermal printer.

FIG. 8 is a block diagram showing the electric circuit of a color thermal printer. A video camera, a VTR, a still video player, a television game machine, and the like is connected to an input terminal 41. A video signal of a tonal image is supplied via the input terminal 41 to a synchronizing signal separation circuit 42 and an analog signal processor 43. The synchronizing signal separation circuit 42 separates a composite synchronizing signal (C. SYNC) from the video signal, and separates a vertical synchronizing signal (V. SYNC) and a horizontal synchronizing signal (H. SYNC) from the composite synchronizing signal. The synchronizing signal separation circuit 42 has an internal horizontal synchronizing signal oscillator, which outputs a horizontal synchronizing signal when the horizontal synchronizing signal cannot be separated from the composite synchronizing signal. The synchronizing signal separation circuit 42 sends the composite synchronizing signal of H or L level, vertical synchronizing signal, and horizontal synchronizing signal to a synchronization judging circuit 44, and sends the composite synchronizing signal to an SSG (synchronizing signal generator) 45.

The synchronizing signal separation circuit 42 generates a FIELD INDEX signal based upon a phase relationship between the vertical synchronizing signal and the horizontal synchronizing signal. If a standard signal conforming with an NTSC system is applied to the input terminal 41, the phase relationship between the vertical synchronizing signal and the horizontal synchronizing signal is different between the odd field and an even field. This phase relationship is detected and the FIELD INDEX signal is generated whose signal level is inverted at each field. If a video signal of only one field is applied to the input terminal 41, the phase relationship between the vertical synchronizing signal and the horizontal synchronizing signal does not change so that the FIELD INDEX signal has always the same signal level. This FIELD INDEX signal is sent to the synchronization judging circuit 44.

SSG 45 controls an analog signal processor 43, an A/D converter 47, a D/A converter 48, and an analog signal processor 49, in accordance with the composite synchronizing signal supplied from the synchronizing signal separation circuit 42. The analog signal processor 43 separates the inputted video signal into a read signal, a green signal, and a yellow signal, and adjusts the levels of these signals which are supplied to the A/D converter 47 whereat they are sampled into each pixel and converted into digital signals. The obtained red, green, and blue image data of each pixel are supplied to a memory controller 50.

Red, green, and blue frame memories 51R, 51G, and 51B each store the image data of two odd and even fields by disposing the image data alternately for each scan line. The memory controller 50 reads and writes the image data of each color.

A system controller 16 is connected to an operation unit 16*a*. The operation unit 16*a* is manipulated to designate one of the operations "through", "print", and "freeze". The operation unit 16*a* is provided with a field select switch for switching between "odd field" and "even field", and with a mode select switch for switching between "frame mode" and "field mode". The system controller 16 controls the memory controller 50 during the image data read/write to and from the frame memories 51R, 51G, and 51B. The system controller 16 controls a sheet feed system 17 to feed or discharge a color thermosensitive recording sheet 4. It also controls the preliminary running and preheating.

When the frame mode is designated, the memory controller 50 writes the image data of the odd and even fields into the frame memories 51R, 51G, and 51B. When the field mode is designated, the memory controller 50 writes the image data of ones of odd and even frames into the frame memories 51R, 51G, and 51B, performs an interpolation process and then writes the frame image data in the frame memories 51R, 51G, and 51B.

During a monitor mode, the memory controller 50 reads the image data from the frame memories 51R, 51G, and 51B and sends the read image data to the D/A converter 48 of the monitor system. In a printing mode, the memory controller 50 reads the image data one line after another from the frame memories 51R, 51G, and 51B, and sends the read image data to a print controller 52 of the printing system.

The monitor system is constituted by the D/A converter 48 and the analog signal processor 49. The D/A converter 48 converts the image data of three colors into analog R, G, and B signals, and sends them to the analog signal processor 49. The analog signal processor 49 converts the supplied R, G, and B signals into video signals of the NTSC system so as to display a frame image on a TV monitor (e.g., domestic appliance TV) connected to an output terminal 53.

Figure 9:
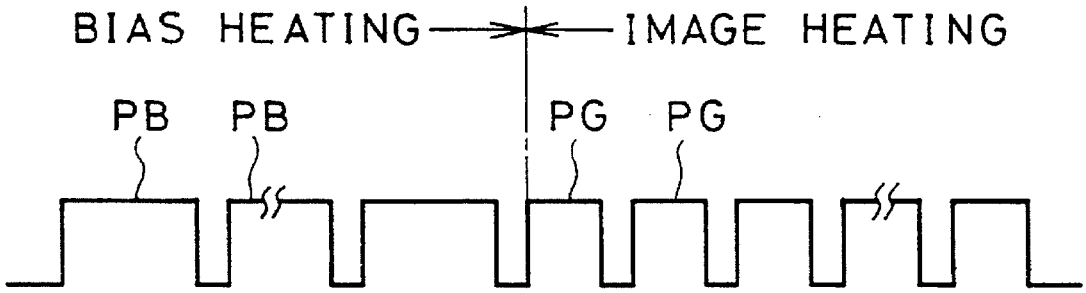
FIG. 9 shows a waveform of bias pulses and image pulses for driving a heating element.
Figure 13:
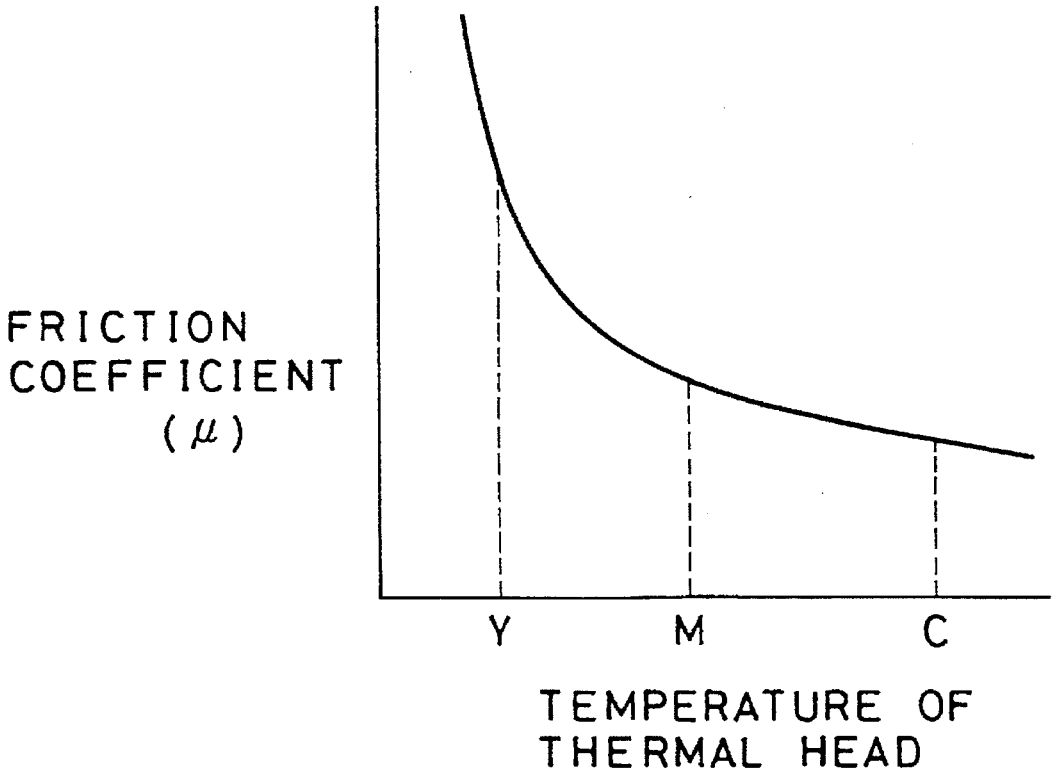
FIG. 13 is a graph showing a friction coefficient between a color thermosensitive recording sheet and a thermal head.

The printing system is constituted by the print controller 52, a thermal head driver 54, and the thermal head 20. The print controller 52 performs a masking process by using image data of three colors, and converts the blue, green and red image data into yellow, cyan, and magenta image data. Of the image data of the three colors, only the image data of the color to be printed, e.g., yellow image data, is picked up one line after another and sent to the thermal head driver 54. As shown in FIG. 9, the thermal head driver 54 generates bias pulses for driving each heating element 20*a* and image pulses PG corresponding in number to the image data, and drives each heating element 20*a*. After one line is printed upon a simultaneous drive of all heating elements 20*a*, the platen drum 10 is rotated by one line.

The system controller 16 performs the preliminary running control before printing the print area PA, to thereby saturate the distortion amount of the sheet feed system 17. During this preliminary running control, the print controller 52 supplies bias pulses PB to each heating element 20*a* via the thermal head driver 54 so as to preheat the heating element 20*a*. In this manner, the preliminary running is completed, the thermal head 20, recording sheet 4, and platen drum 10 enter a thermal equilibrium state. Printing at a desired density can therefore be performed starting from the print start position P1 of the print area PA, and a grey balance is kept well even immediately after the print start. The system controller 16 performs the yellow stain compensation during the cyan binary image printing process.

Next, the operation of the above-described embodiment will be described. First the operation of printing only a half tone image will be explained. As shown in FIG. 1, during the initial sheet feed, the platen drum 10 is stationary at the home position HP whereat the clamper 14 is maintained generally vertically. The feed roller pair 26 nips the color thermosensitive recording sheet 4 supplied from a cassette (not shown) and feeds it toward the platen drum 10. The feed roller pair 26 temporarily stops when the front end portion of the color thermosensitive recording sheet 4 enters between the platen drum 10 and the clamper 14. After the clamper clamps the front end portion of the color thermosensitive recording sheet 4, the platen drum 10 and the feed roller pair 26 rotate so that the recording sheet 4 is wound on the circumferential wall of the platen drum 10.

The pulse motor 12 rotates the platen drum 10 by one line upon reception of four pulses during the printing operation. After one line is printed, the platen drum 10 is again rotated as far as one line. When the number of pulses becomes "A-Pα", the system controller 16 detects that the preliminary running start position α1 for the yellow printing reaches the heating element array HA. The system controller 16 activates the pressing mechanism 23 to push the heating element array HA of the thermal head 20 against the color thermosensitive recording sheet 4 on the platen drum 10. The bias pulse PB is supplied to each heating element 20*a* to preheat it at the yellow bias heat energy BY. After the preliminary running is performed for a predetermined number of lines (e.g., Pαy), the heating element array HA faces the print start position P1 of the print area PA.

In printing the first line of the print area PA, the system controller 16 drives each heating element by a predetermined number of bias pulses PB to supply the yellow bias heating energy BY to the color thermosensitive recording sheet 4. After this bias heating, each heating element 20*a* is image-heated by the image pulses PG corresponding to the image data. In this manner, the yellow image first line is printed at the print start position P1 of the print area PA shown in FIG. 4. Thereafter, the yellow image is printed one line after another. After the completion of the yellow printing, the thermal head 20 is moved up to retract it from the color thermosensitive recording sheet 4.

When the yellow image printed area reaches the optical fixing unit 21, ultraviolet rays having an emission peak of 420 nm wavelength is radiated. As a result, a diazonium salt compound in the yellow thermosensitive coloring layer 8 still not subjected to coloring is optically decomposed to dismiss the coloring ability of the yellow thermosensitive coloring layer 8.

As shown in FIG. 5, after the end portion of the print area PA is optically fixed by the optical fixing unit 21, the platen drum 10 is then rotated at a high speed. During this high speed rotation, when the home position sensor 29 detects the home position, counting the number of drive pulses of the pulse motor 12 starts. When the count reaches "A-Pαm", the preliminary running is performed in the manner like the yellow printing operation. During this preliminary running operation, the heating element array HA of the thermal head 20 is again pushed against the color thermosensitive recording sheet 4 and each heating element 20*a* generates the magenta bias heat energy to perform preheating. After the preliminary running for the same lines as the yellow image printing operation is completed, the magenta image starts being printed.

In the magenta printing operation, each heating element 20*a* is driven by predetermined bias data to supply the magenta bias heat energy BM to the color thermosensitive recording sheet 4. After this bias heating, each heating element 20*a* is driven by the image data of the first line of the magenta image to perform image heating. In this manner, the magenta image first line is printed at the print start position P1 of the print area PA shown in FIG. 4. Thereafter, the magenta image is printed one line after another. After the magenta image is printed completely for all lines, the thermal head 20 is moved up to retract it from the color thermosensitive recording sheet 4. The magenta image printed area is subjected to ultraviolet rays having an emission peak of 365 nm wavelength by the optical fixing unit 22 to destroy the coloring ability of the magenta thermosensitive coloring layer 7.

Also in the cyan printing process, the preliminary running with preheating at the cyan bias heat energy BC is performed. After this preliminary running, the cyan image first line is printed at the print start position P1 of the print area. Thereafter, the second and following lines of the cyan image are sequentially printed. After the cyan image is printed for all lines in the print area PA, the thermal head 20 is moved up.

After the completion of printing three color images, the platen drum 10 and the feed roller pair 26 are rotated in the reverse direction during the time period T4. With this reverse rotation of the platen drum 10, the back end portion of the color thermosensitive recording sheet 4 is guided by the separation claw 27 to the sheet eject/discharge path 25 and nipped by the feed roller pair 26. Thereafter, the clamper 14 is opened to discharge the already thermally printed color thermosensitive recording sheet 4 onto a tray (not shown) via the sheet eject/discharge path 25.

Next, the operation of printing characters of a title or the like on the print area PA will be described. In this case, the time image print mode is designated. Upon this designation, the system controller 16 performs the yellow stain compensation for the blank area during the cyan printing so as to reduce the heat energy of bias heating. For the yellow stain compensation, the preliminary running control for the cyan printing is performed in accordance with the preliminary running start position data $P\alpha c_{sr}$. As a result, the print start positions of the three colors coincide with each other, and a displacement of the positions of three color dots becomes small. During the yellow and magenta printing operations, the preliminary running control similar to the half tone printing operation is performed.

Some postcard has both a half tone image area and a binary image area juxtaposed with the half tone image area. Similar to the half tone printing described above, after the preliminary running with preheating, the half tone image area and the binary image area are printed by a three-color frame sequential printing method. In printing a cyan image, first the half tone image such as a scene image is printed without the yellow stain compensation, and then in the binary image area cyan characters are printed while the yellow stain compensation is performed.

As compared to the bias heating of all heating elements always at the constant cyan bias heating energy BC, the cyan printing with the yellow stain compensation has the smaller total amount at which the heating element array HA generates heat. Therefore, the friction coefficient between the color thermosensitive recording sheet and the thermal printer becomes large so that the sheet feed amount at the binary image area during the cyan printing becomes smaller. Cyan dots in the binary image area are displaced in position from the yellow and magenta dots so that a color registration shift occurs.

Figure 10:
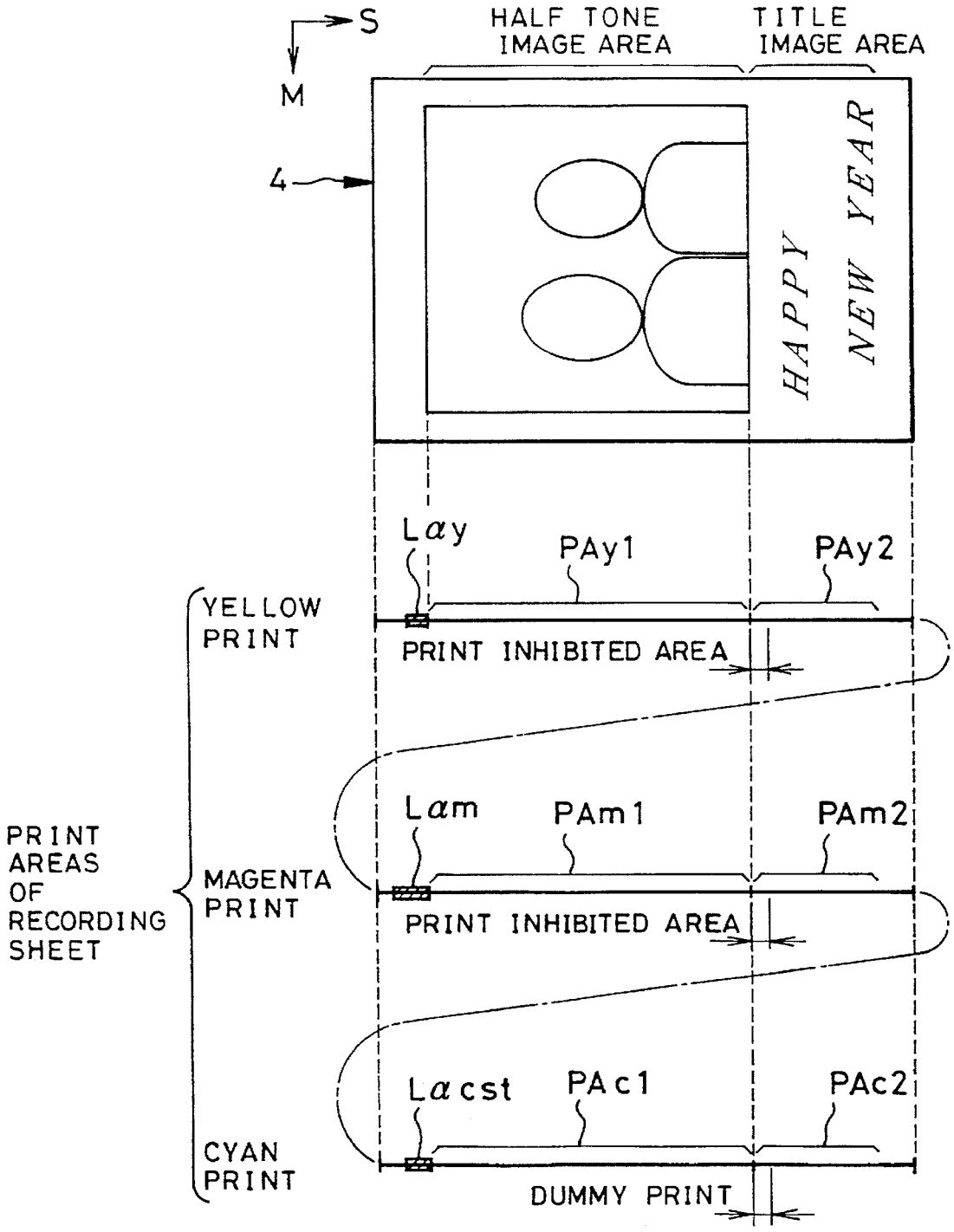
FIG. 10 is a diagram similar to FIG. 5 showing an example of a print of a postcard.
Figure 11A:
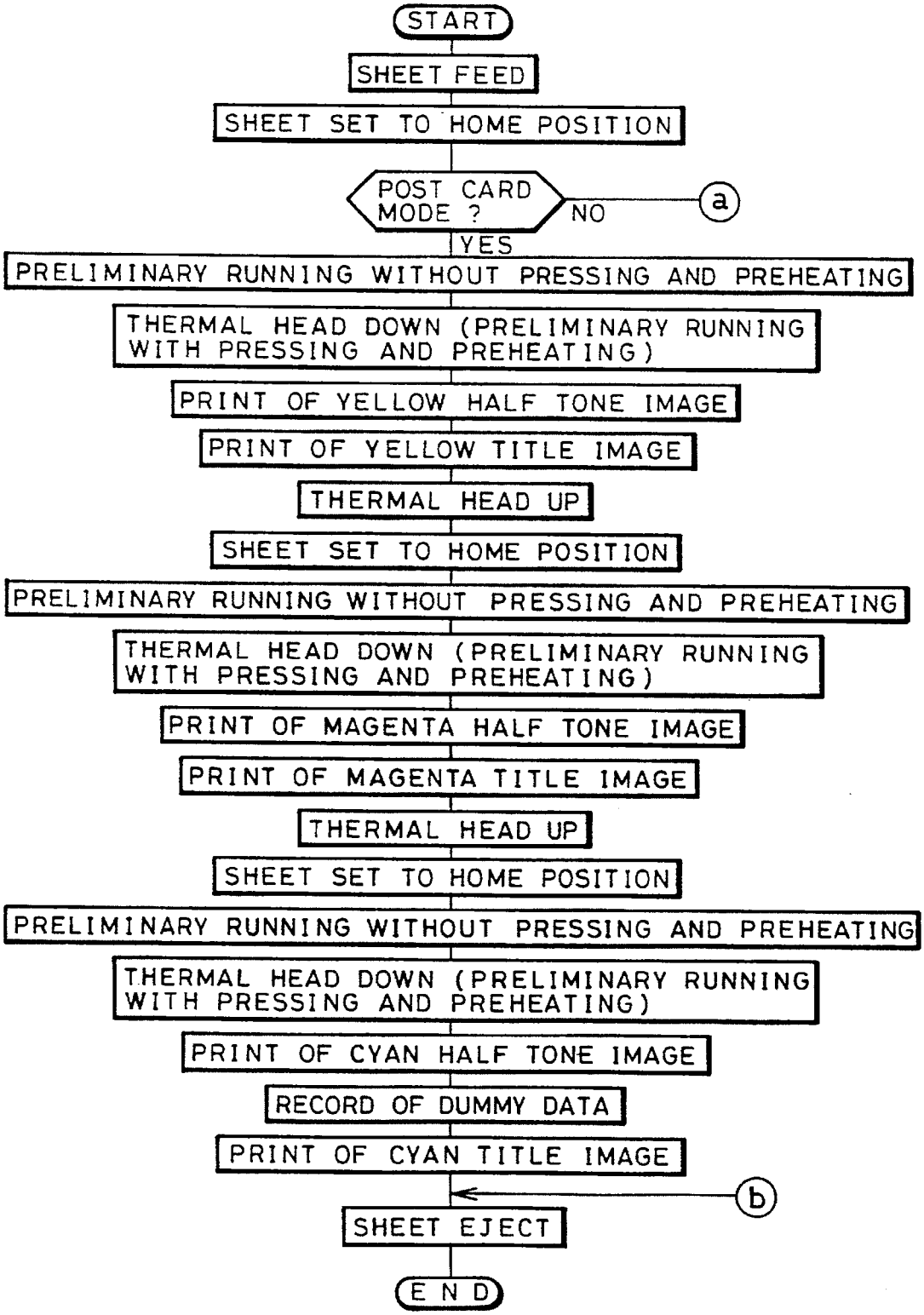
FIGS. 11A and 11B are a flow chart explaining the operations of printing a half tone image and a postcard.
Figure 11B:
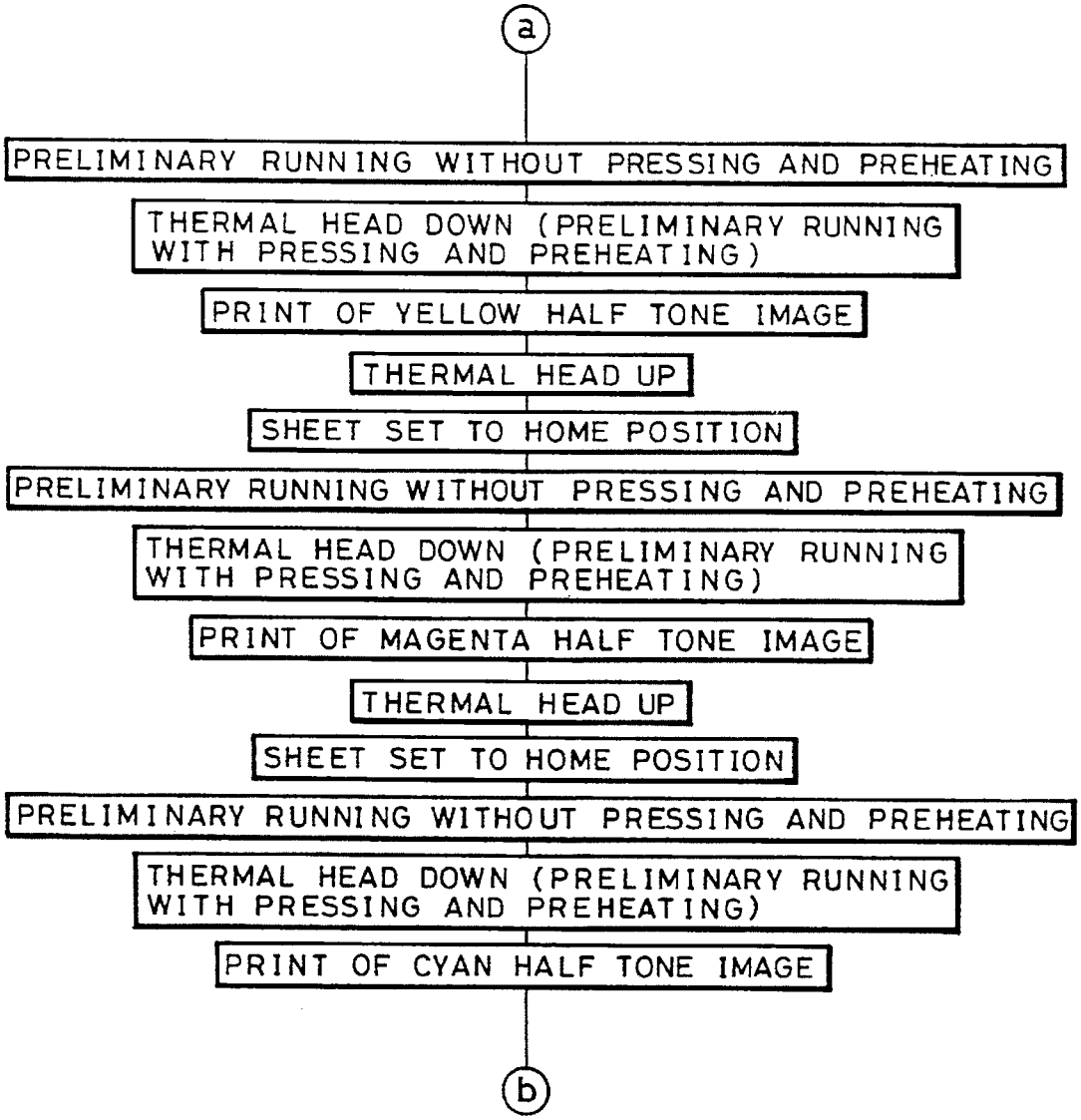

In order to eliminate the color registration shift, this embodiment provides dummy print lines at the front end portion of the binary image area PAc2 for the cyan printing, as shown in FIGS. 10 and 11. The dummy print lines are printed by dummy data under the control of the print controller 52. The dummy data is generally the same as the magenta bias data for generating the magenta bias heat energy BM. The dummy print line is therefore printed by pulses which are the same in number as that of magenta bias pulses. The dummy print lines are used as a binary image print inhibited area for the yellow and magenta printing operations. In this print inhibited area, only the bias heating is performed during the yellow and magenta image printing operations. Instead of performing the bias heating in the print inhibited area, the color thermosensitive recording sheet may be fed without any printing operation.

Specifically, since the friction coefficient between the color thermosensitive recording sheet and the thermal head increases because of the yellow stain compensation, the interval of first several lines in the binary image print area becomes dense so that the length of the print area of cyan characters is shortened by two to three lines more than the print area of yellow and magenta characters. If printing cyan characters is performed after the feed of two or three lines, the lengths of the print areas of three colors can be made equal. Therefore, as shown in FIG. 10, the dummy print lines are provided when a cyan image is printed in the binary image area, and the dummy print lines are printed by dummy data which heats the binary image area so as not to develop cyan color. Thereafter, the first and following lines of cyan characters are sequentially printed.

On the other hand, the print inhibited area is set for the yellow and magenta printing operations in correspondence with the dummy print lines. Therefore, although the blank area is formed at the front end portion of the binary image print area PAc2, characters of three colors can be printed without any color registration shift and any blur of the contour of each character.

FIG. 11 is a flow chart explaining the printing operation to be executed by the color thermal printer shown in FIG. 8. In the printing operation, it is possible to select one of a normal mode for printing only a half tone image area and a postcard mode for printing both a half tone image area and a binary image area. In the normal mode, images of yellow, magenta, and cyan colors are sequentially printed. In the postcard mode, first the yellow half tone image is printed, and then yellow characters are printed. Similarly, the magenta half tone image is printed, before magenta characters are printed. Thereafter, the cyan half tone image is printed followed by printing the three dummy print lines for a blank space according to dummy data, and thereafter cyan characters are printed.

In this embodiment, three dummy print lines are used. The number of dummy print lines is determined from experiments so as to provide a proper print quality under the conditions that the black factor (print pixel/total pixels on one line) is 40 to 50%. In this embodiment, although the two modes including the normal mode and postcard mode are used, a character mode for printing only a binary image may be added.

The dummy print may be omitted for the cyan image recording. In this case, printing the image data starts from the fourth line for the yellow and magenta printing operations, whereas printing the image data starts from the first line for the cyan image printing operation.

Figure 12:
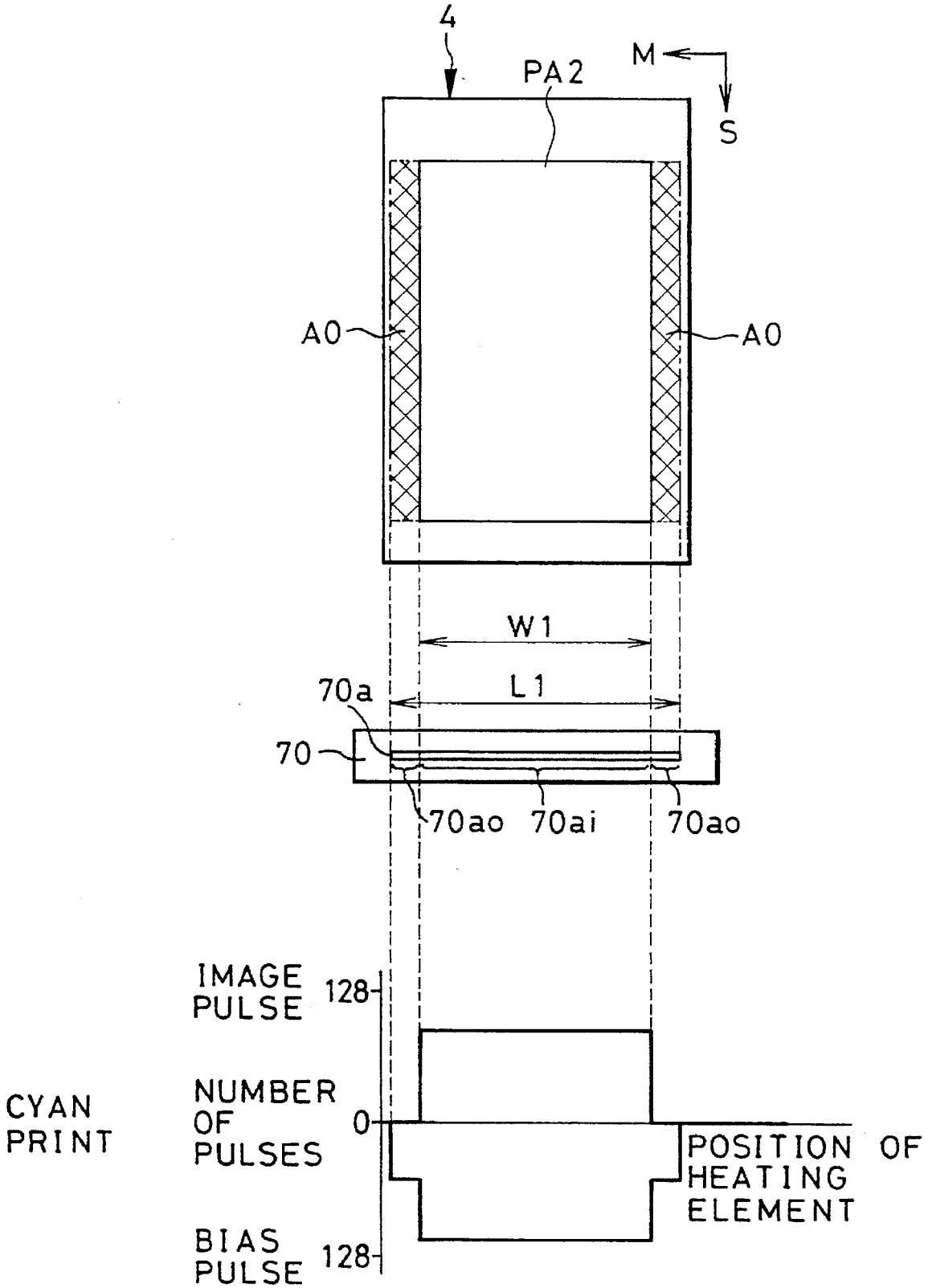
FIG. 12 is a diagram explaining a printing condition using a heating element array longer than the width of a print area.

As shown in FIG. 12, if the length of a heating element array 70*a* of a thermal head 70 is greater than the width W1 of the print area PA2, the heating elements 70*ao* are positioned outward of the print area PA2 on the right and left sides thereof. These heating elements 70*ao* face, for example, the blank frame surrounding the half tone image. The heating elements facing the blank frame are supplied with the image data of "0" so that the image heating is not performed. However, all the heating elements of the heating element array 70*a* are subjected to the same bias heating. Therefore, by the cyan bias heating, yellow stains are formed on the blank area.

In order to prevent yellow stains from being formed, the yellow stain compensation is performed for the heating elements 70*ao* positioned outward of the print area. Specifically, during the cyan bias heating, the heating elements 70*ao* are caused to generate a heat energy approximate to the magenta heat bias energy. In this embodiment, the thermal print is conducted at the width W1 by 512 heating elements 70*a*. The number of heating elements may be changed with the size of a color thermosensitive recording sheet. The heating elements 70*ao* may be maintained in a non-operative state without the bias heating during all the yellow, magenta, and cyan printing operations.

Instead of reducing the number of bias pulses to reduce the heat energy for the yellow stain compensation, the voltage of each bias pulse may be lowered, or the combination of these two methods may also be used. Instead of performing the bias heating and the image heating by using a plurality of drive pulses, a single pulse of a long pulse width may also be used for the bias heating and the image heating.

In the above embodiment, the color thermosensitive recording sheet is formed by laying the thermosensitive coloring layers in the order of cyan, magenta, and yellow on the base. In the case of a color thermosensitive recording sheet that may have a different laying order, the bias heating for the lowermost thermosensitive coloring layer can be performed by being determined equal to a bias heat energy of the thermosensitive coloring layer at the second lowermost layer so as to suppress the generation of yellow stains.

The invention is also applicable to a three-head one-pass system in which three thermal heads are used and three-color images are sequentially printed while a platen drum rotates once. Furthermore, a color thermosensitive recording sheet may be linearly and reciprocally moved by disposing feed roller pairs on the right and left sides of a small diameter platen roller for feeding the recording sheet.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

We claim:

1. A direct color thermal printing method of printing an image on a print area of a color thermosensitive recording sheet by pressing and heating said color thermosensitive recording sheet with a thermal head, said color thermosensitive recording sheet being formed by at least first to third thermosensitive coloring layers having a different developing color and a different heat sensitivity, respectively laid in order on a base, said image being printed frame-sequentially starting from said third thermosensitive coloring layer lying uppermost and having a highest heat sensitivity, said third and second thermosensitive coloring layers being optically fixed immediately after the printing by radiating an electromagnetic wave having a specific wavelength range, said thermal head including a heating element array having a plurality of heating elements disposed in line in a main scan direction, said thermal head and said color thermosensitive recording sheet relatively moving in a subsidiary direction perpendicular to said main scan direction, said direct color thermal printing method comprising the steps of:

in printing said image on said third and second thermosensitive coloring layers, applying a bias heat energy slightly short of starting coloring of said thermosensitive coloring layers and an image heat energy corresponding to a coloring density to said color thermosensitive recording sheet through each said heating element for printing one dot;

in printing said first thermosensitive coloring layer lying lowermost, dividing said plurality of heating elements into a first group to record part of said image and a second group to face a blank area of said image;

applying a bias heat energy slightly short of starting coloring of said first thermosensitive coloring layer and an image heat energy corresponding to a coloring density to said color thermosensitive recording sheet, through each said heating element belonging to said first group for printing one dot; and applying a first heat energy lower than said bias heat energy slightly short of starting coloring of said first thermosensitive coloring layer to said color thermosensitive recording sheet, thorough each said heating element belonging to said second group.

2. A direct color thermal printing method according to claim 1, wherein said first heat energy is substantially equal to a bias heat energy slightly short of starting coloring of said second thermosensitive coloring layer.

3. A direct color thermal printing method according to claim 2, wherein said first thermosensitive coloring layer is a cyan thermosensitive coloring layer for developing cyan color, said second thermosensitive coloring layer is a magenta thermosensitive coloring layer for developing magenta color, and said third thermosensitive coloring layer is a yellow thermosensitive coloring layer for developing yellow color.

4. A direct color thermal printing method according to claim 3, wherein said color thermosensitive recording sheet is wound on the outer circumference of a rotatable platen drum, with the front portion of said color thermosensitive recording sheet being clamped by a clamper, and said thermal head extends in the axial direction of said platen drum.

5. A direct color thermal printing method according to claim 4, wherein said platen drum includes a metal shaft and a rubber roller, and is rotated by a pulse motor via a belt.

6. A direct color thermal printing method according to claim 5, wherein said platen drum is rotated by one line after said thermal head prints one line.

7. A direct color thermal printing method according to claim 3, further comprising the step of providing a preliminary pressed running section directly before said print area, wherein said preliminary running section for said yellow thermosensitive coloring layer having a highest heat sensitivity has a small length, said preliminary running section for said cyan thermosensitive coloring layer having a lowest heat sensitivity has a great length, and said thermal head is preheated while pressed against said color thermosensitive recording sheet in said preliminary running section.

8. A direct color thermal printing method according to claim 3, wherein if the length of said heating element array is longer than the width of said print area, the heating elements positioned in said print area constitute said first group, and the heating elements outside said print area constitute said second group.

9. A direct color thermal printing method according to claim 3, wherein said image is a character surrounded by said blank area.

10. A direct color thermal printing method of printing an image on a print area of a color thermosensitive recording sheet by pressing and heating said color thermosensitive recording sheet with a thermal head, said color thermosensitive recording sheet being formed by at least first to third thermosensitive coloring layers having a different developing color and a different heat sensitivity, respectively laid in order on a base, said image being printed frame-sequentially starting from said third thermosensitive coloring layer lying uppermost and having a highest heat sensitivity, said third and second thermosensitive coloring layers being optically fixed immediately after the printing by radiating an electromagnetic wave having a specific wavelength range, said thermal head including a heating element array having a plurality of heating elements disposed in line in a main scan direction, said thermal head and said color thermosensitive recording sheet relatively moving in a subsidiary direction perpendicular to said main scan direction, said direct color thermal printing method comprising the steps of:

dividing said print area into a half tone image area and a binary image area juxtaposed in said subsidiary direction, a full-color image being recorded in said half tone image area, and a binary image such as a character and a line in a blank area being recorded in said binary image area;

in sequentially printing to each said thermosensitive coloring layer in said half tone image area, applying a bias heat energy slightly short of starting coloring of said thermosensitive coloring layer and an image heat energy corresponding to a coloring density to said color thermosensitive recording sheet, through each said heating element for printing one dot;

in sequentially printing to said third and second thermosensitive coloring layers in said binary image area, applying a bias heat energy slightly short of starting coloring of said thermosensitive coloring layers and an image heat energy corresponding to a coloring density to said color thermosensitive recording sheet, through each said heating element for printing one dot;

in printing to said first thermosensitive coloring layer lying lowermost in said binary image area, dividing said plurality of heating elements into a first group to record part of said character and a second group to face a blank area of said image;

applying a bias heat energy slightly short of starting coloring of said first thermosensitive coloring layer and an image heat energy corresponding to a coloring density to said color thermosensitive recording sheet, through each said heating element belonging to said first group for printing one dot;

applying a first heat energy lower than said bias heat energy slightly short of starting coloring of said first thermosensitive coloring layer to said color thermosensitive recording sheet, through each said heating element belonging to said second group;

in printing to said third and second thermosensitive coloring layers in said binary image area, determining a predetermined number of first lines in said binary image area as print inhibited lines; and in printing to said first thermosensitive coloring layer in said binary image area, using said predetermined number of first lines as dummy print lines, said dummy print lines printed by applying a first heat energy lower than said bias heat energy slightly short of starting coloring of said first thermosensitive coloring layer, and after the printing of said dummy print lines, starting the printing of said binary image.

11. A direct color thermal printing method according to claim 10, wherein said binary image area is located past said half tone image area.

12. A direct color thermal printing method according to claim 11, wherein said first heat energy is substantially equal to a bias heat energy slightly short of starting coloring of said second thermosensitive coloring layer.

13. A direct color thermal printing method according to claim 12, further comprising the step of applying only said bias heat energy slightly short of starting coloring to said color thermosensitive recording sheet for said print inhibited lines.

14. A direct color thermal printing method according to claim 13, wherein said first thermosensitive coloring layer is a cyan thermosensitive coloring layer for developing cyan color, said second thermosensitive coloring layer is a magenta thermosensitive coloring layer for developing magenta color, and said third thermosensitive coloring layer is a yellow thermosensitive coloring layer for developing yellow color.

15. A direct color thermal printing method according to claim 14, wherein said color thermosensitive recording sheet is wound on the outer circumference of a rotatable platen drum, with the front portion of said color thermosensitive recording sheet being clamped by a clamper, and said thermal head extends in the axial direction of said platen drum.

16. A direct color thermal printing method according to claim 15, further comprising the step of providing a preliminary pressed running section directly before said print area, wherein said preliminary running section for said yellow thermosensitive coloring layer having a highest heat sensitivity has a small length, said preliminary running section for said cyan thermosensitive coloring layer having a lowest heat sensitivity has a great length, and said thermal head is preheated while pressed against said color thermosensitive recording sheet in said preliminary running section.

* * * * *